US008277203B2

(12) United States Patent
Horng

(10) Patent No.: US 8,277,203 B2
(45) Date of Patent: Oct. 2, 2012

(54) DC FAN OF INNER ROTOR TYPE

(75) Inventor: Alex Horng, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 486 days.

(21) Appl. No.: 12/496,736

(22) Filed: Jul. 2, 2009

(65) Prior Publication Data

US 2011/0002800 A1 Jan. 6, 2011

(51) Int. Cl.
*F04B 35/04* (2006.01)

(52) U.S. Cl. ..... 417/353

(58) Field of Classification Search ..... 310/62, 310/63; 417/353, 423.7; 361/695
See application file for complete search history.

(56) References Cited

U.S. PATENT DOCUMENTS 3,303,995 A * 2/1967 Boeckel ..... 417/353
3,648,090 A * 3/1972 Voin ..... 310/191
4,563,622 A * 1/1986 Deavers et al. ..... 318/400.26
4,673,342 A 6/1987 Saegusa
5,075,605 A 12/1991 Hendricks et al.
6,013,966 A * 1/2000 Fehrenbacher et al. ..... 310/257
6,069,423 A * 5/2000 Miller et al. ..... 310/51
6,076,795 A * 6/2000 Scheidel et al. ..... 248/603
6,081,059 A 6/2000 Hsu
6,091,172 A 7/2000 Kakinuma et al.
6,768,242 B1 * 7/2004 Suzuki et al. ..... 310/216.074
6,819,068 B2 * 11/2004 Horng et al. ..... 318/400.38
6,830,440 B1 * 12/2004 Riddoch ..... 417/353
7,129,608 B2 * 10/2006 Eppler et al. ..... 310/89
2004/0056613 A1 * 3/2004 Horng et al. ..... 318/254
2007/0176502 A1 * 8/2007 Kasai et al. ..... 310/71
2008/0024023 A1 * 1/2008 Jiang et al. ..... 310/89

* cited by examiner

*Primary Examiner* — Devon Kramer
*Assistant Examiner* — Amene Bayou
(74) *Attorney, Agent, or Firm* — Alan Kamrath; Kamrath IP Lawfirm, PA

(57) ABSTRACT

A DC fan of an inner rotor type includes a housing having a frame defining a compartment. A rotor is rotatably received in the compartment. The rotor includes a shaft having an outer periphery and a permanent magnet fixed to and around the outer periphery of the shaft. A stator is fixed in the compartment of the frame and surrounds the rotor. The stator includes a plurality of magnetic pole faces facing an outer periphery of the permanent magnet. An air gap is formed between each magnetic pole face and the permanent magnet. The stator further includes at least one coil. An impeller is coupled to an end of the shaft. A drive control unit is mounted in the compartment and electrically connected to the at least one coil of the stator.

5 Claims, 3 Drawing Sheets

DC FAN OF INNER ROTOR TYPE

BACKGROUND OF THE INVENTION

1. Field of the Invention

The present invention relates to a DC fan and, more particularly, to a DC fan of an inner rotor type.

2. Description of the Related Art

FIG. 1 shows a conventional DC fan 9 of an inner rotor type. Specifically, the DC fan 9 includes a housing 91 having a compartment 910. A stator 92 is fixed to an inner periphery of the housing 91. A rotor 93 is rotatably received in the compartment 910. An impeller 94 is coupled to an end of the rotor 93. The stator 92 includes an annular permanent magnet 921 surrounding the rotor 93. The stator 92 further includes a brush 922 adjacent an end of the permanent magnet 921 and electrically connected to a DC power source. The rotor 93 includes a shaft 931, a winding core 932, and a converter 933. An end of the shaft 931 extends beyond the housing 91. The winding core 932 is mounted around the shaft 931 and includes an outer periphery facing the permanent magnet 921 with an air gap formed between the winding core 932 and the permanent magnet 921. Electricity passing through the coil of the winding core 932 interacts with the magnetic field created by the permanent magnet 921. The converter 933 is also mounted around the shaft 931 and electrically connected to the coil of the winding core 932. The converter 933 has an outer periphery for sliding, electrical contact with the brush 922.

In operation, when DC power is supplied from the DC power source to the brush 922 of the stator 92, the DC power is transmitted through the converter 933 of the rotor 93 to the coil of the winding core 932. Electric current generated in the coil by the DC power interacts with a magnetic field created by the permanent magnet 921, driving the rotor 93 to rotate relative to the stator 92. The speed of the rotor 93 can be decided by controlling the DC power to modulate the current in the coil of the winding core 932.

However, the converter 933 is parallel to the shaft 931 and includes a plurality of spaced converter plates, such that sparks are liable to occur between the brush 922 and the converter 933 when the brush 922 moves from one of the converter plates to an adjacent converter plate. At the same time, a noise signal adversely affecting the system self-control is apt to be generated. Further, the brush 922 must be in tight contact with the outer periphery of the converter 933 to assure electrical connection therebetween. To avoid adverse affect to the electrical connection between the brush 922 and the converter 933 by accumulated carbon resulting from sparks, the worn-out brush 922 must be periodically replaced, and the outer periphery of the converter 933 must be periodically cleaned. Further, although the speed of the rotor 93 can be decided by controlling the DC power, noise signals are apt to be generated during DC power transmission between the brush 922 and the converter 933, for the brush 922 moves between the converter plates. As a result, the DC fan 9 can not be utilized in products requiring precise control of the speed of the fan. Further, when the load of the DC fan 9 is changed, an additional sensing device such as a mechanical governor, an electronic governor, a speed signal generator, or an optical encoder is required to feed back the actual speed of the DC fan 9, so that the voltage of the DC power can be adjusted to drive the DC fan 9 to rotate at an expected speed. However, the manufacturing costs of the DC fan 9 are increased, while the accuracy of the sensing device affects the controlling quality of the speed.

Thus, a need exists for a DC fan allowing precise speed control while allowing easy assembly and manufacture at low costs.

SUMMARY OF THE INVENTION

The primitive objective of the present invention is to provide a DC fan of an inner rotor type including a drive control unit that generates control current directly outputted to coils of a stator to provide the DC fan with high control sensitivity and high control precision, allowing intelligent speed control.

Another objective of the present invention is to provide a DC fan of an inner rotor type including a stator directly fixed in a compartment of a housing by injection molding to enhance assembling convenience.

A further objective of the present invention is to provide a DC fan of an inner rotor type including a permanent magnet and a plurality of magnetic pole faces each having a length along an axis of the rotor equal to that of the permanent magnet, so that a better driving efficiency is provided between the stator and the rotor.

A DC fan according to the preferred teachings of the present invention includes a housing having a frame defining a compartment. A rotor is rotatably received in the compartment. The rotor includes a shaft having an outer periphery and a permanent magnet fixed to and around the outer periphery of the shaft. A stator is fixed in the compartment of the frame and surrounds the rotor. The stator includes a plurality of magnetic pole faces facing an outer periphery of the permanent magnet. An air gap is formed between each magnetic pole face and the permanent magnet. The stator further includes at least one coil. An impeller is coupled to an end of the shaft. A drive control unit is mounted in the compartment and electrically connected to the at least one coil of the stator.

Preferably, the frame is formed by injection molding to enclose and engage with the stator, further reducing assembling complexity. The permanent magnet has a length along an axis of the rotor equal to that of each magnetic pole face along the axis of the rotor.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

Figure 1:
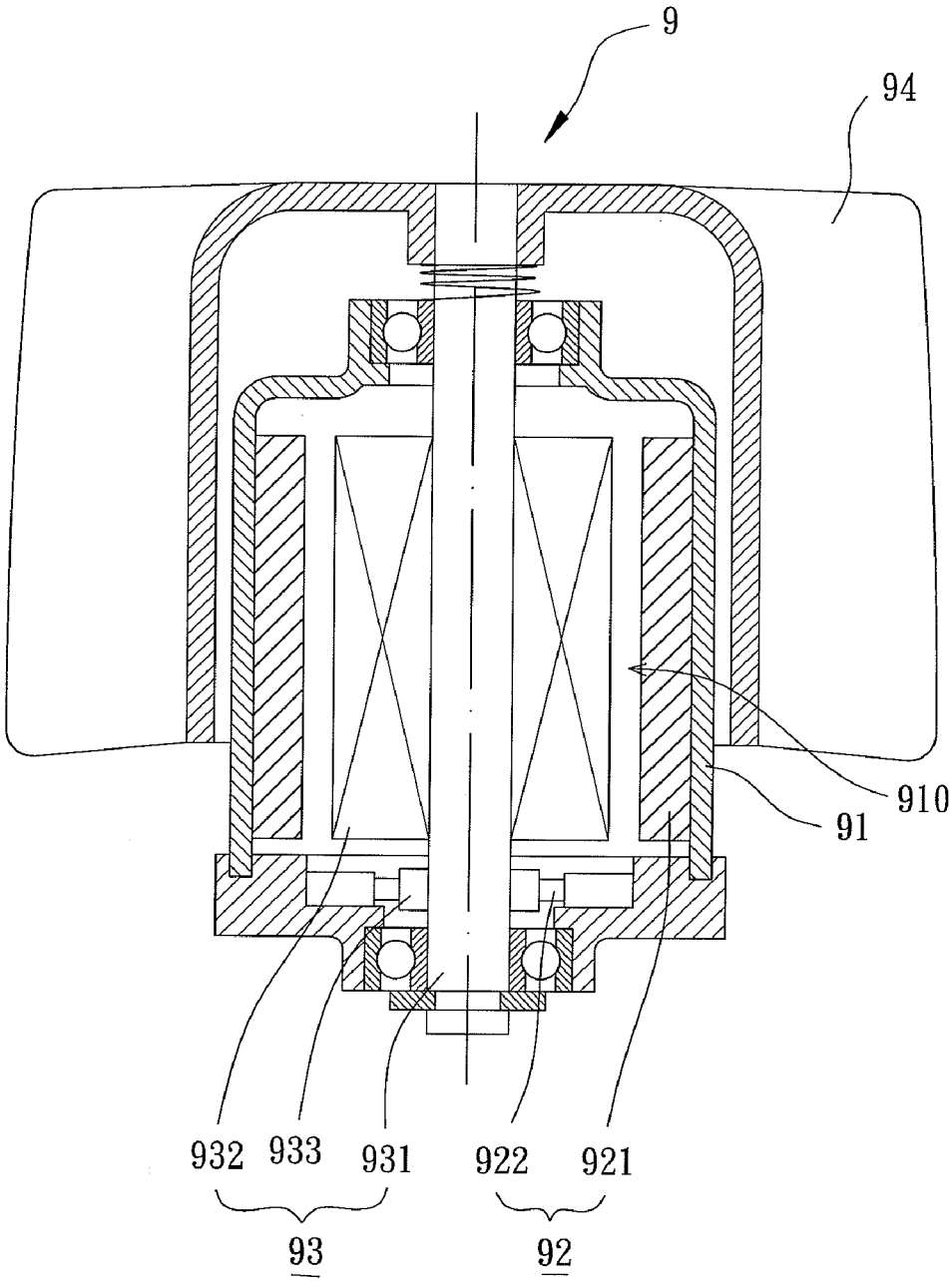
FIG. 1 PRIOR ART
FIG. 1 shows a cross sectional view of a conventional DC fan.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "inner", "outer", "end", "radial", "annular", "outward", "inward", "length", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

Figure 2:
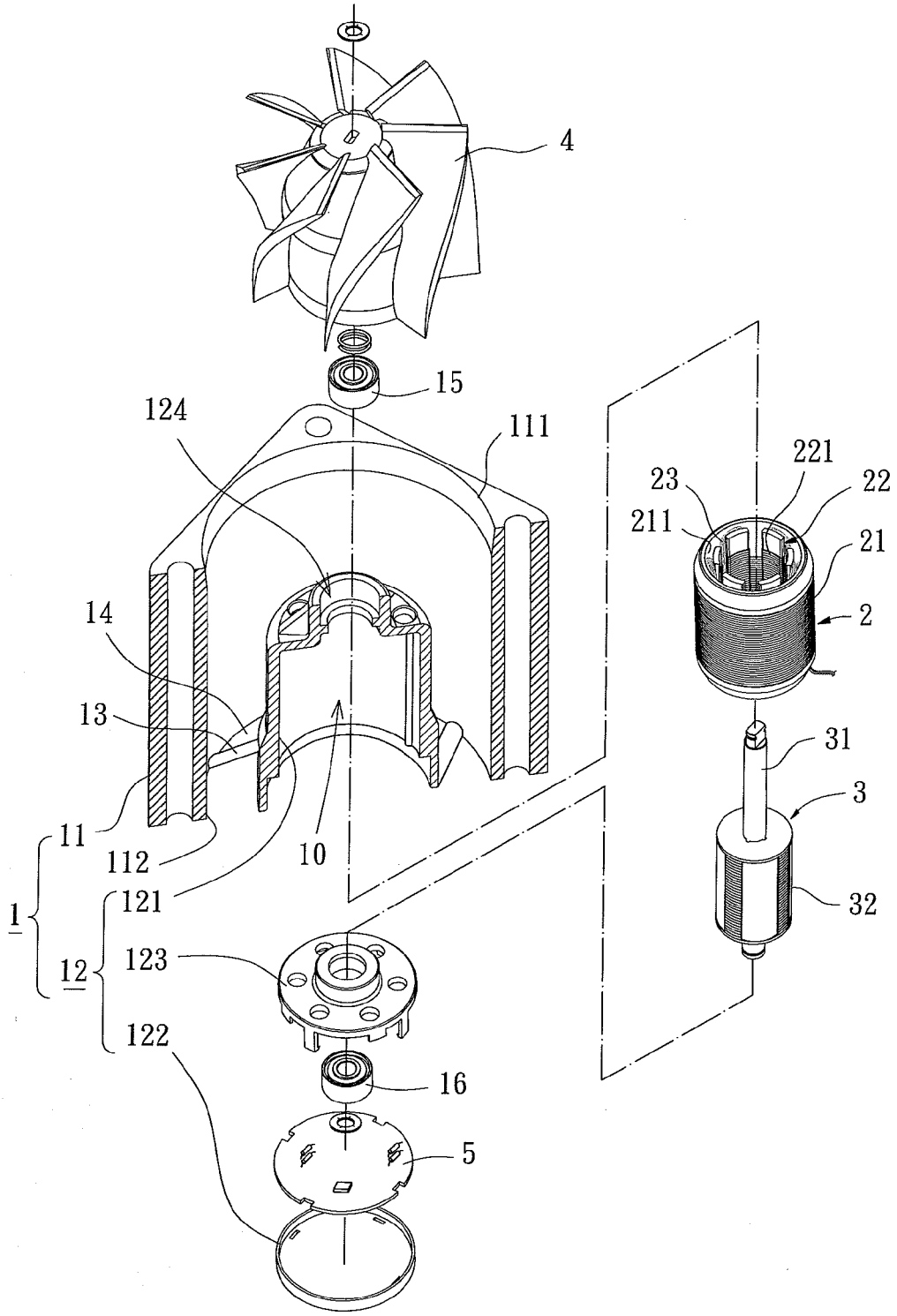
FIG. 2 shows an exploded, perspective view of a DC fan of an inner rotor type according to the preferred teachings of the present invention.
Figure 3:
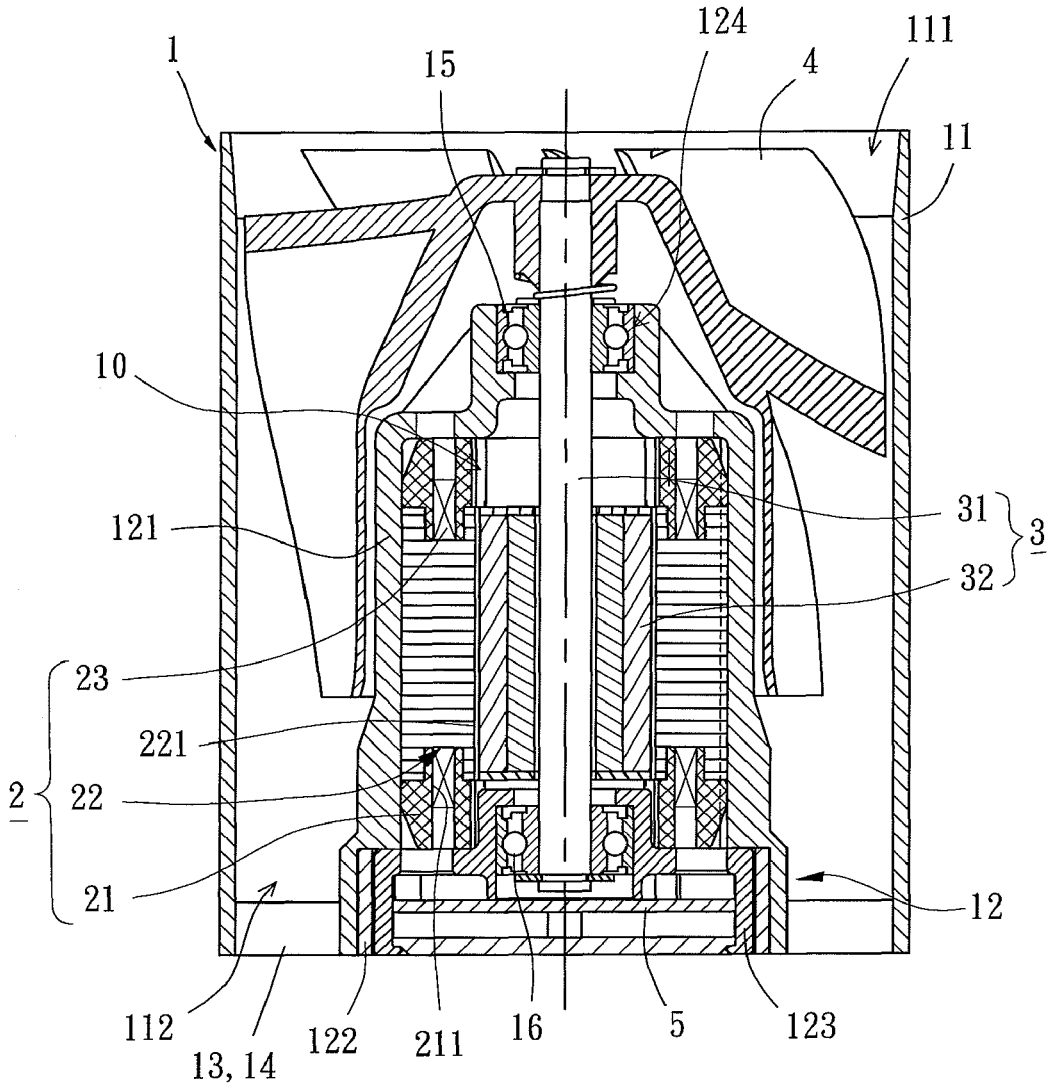
FIG. 3 shows a cross sectional view of the DC fan of the inner rotor type of FIG. 2.

A DC fan of an inner rotor type according to the preferred teachings of the present invention is shown in FIGS. 2 and 3 of the drawings and generally includes a housing 1, a stator 2, a rotor 3, an impeller 4, and a drive control unit 5. The housing 1 includes an outer casing 11 and a frame 12. The outer casing 11 includes an air inlet 111 and an air outlet 112 spaced from the air inlet 111 along an axis of the rotor 3. The frame 12 is mounted inside the outer casing 11 between the air inlet 111 and the air outlet 112. The frame 12 is interconnected by one or more connecting members 13 to the outer casing 11, defining a passageway 14 between the frame 12 and the outer casing 11. Preferably, the outer casing 11, the frame 12, and the connecting members 13 are integrally formed as a single continuous monolithic member. Preferably, the connecting members 13 are adjacent the air outlet 112 of the outer casing 11 and in the form of ribs or stationary vanes.

In the preferred form shown, the frame 12 includes a body 121, a bottom plate 122, and a positioning member 123. The body 121 and the bottom plate 122 are coupled to each other and define a compartment 10. The positioning member 123 is fixed in the compartment 10 and adjacent the stator 2. The frame 12 further includes an opening 124 formed in a top of the body 121 and facing the air inlet 111. A first bearing 15 is mounted in the opening 124. A second bearing 16 is coupled to the positioning member 123. The first and second bearings 15 and 16 are aligned with each other and spaced along the axis. It can be appreciated that the housing 1 of the DC fan according to the teachings of the present invention can include only the frame 12 having the compartment 10.

In the preferred form shown, the stator 2 is mounted around the rotor 3 and fixed between the first and second bearings 15 and 16. The stator 2 includes a cylindrical body 21, a plurality of poles 22, and a plurality of coils 23. Each pole 22 has an end interconnected to an inner periphery 211 of the cylindrical body 21. The other end of each pole 22 extends radially inward toward a central axis of the cylindrical body 21 and forms a magnetic pole face 221. Preferably, the poles 22 are formed on the inner periphery 211 and annularly spaced at regular intervals and arranged about the central axis of the cylindrical body 21 in a radial manner. The coils 23 are respectively wound around the poles 22. By such an arrangement, the magnetic pole face 221 of each pole 22 is magnetized into a magnetic pole to drive the rotor 3 to rotate when electric current is introduced into each coil 23. Furthermore, in a case that the frame 12 of the housing 1 is formed by injection molding, the frame 12 can enclose and engage with the stator 2 so that the stator 2 directly engages with the inner periphery of the frame 12. Thus, the complexity in assembly of the DC fan according to the preferred teachings of the present invention can be significantly reduced.

In the preferred form shown, the rotor 3 is rotatably received in the compartment 10 and includes a shaft 31 and a permanent magnet 32. An end of the shaft 31 extends through the first bearing 15 and beyond the frame 12 to couple with the impeller 4. The other end of the shaft 31 is coupled with the second bearing 16. The permanent magnet 32 is fixed to and around an outer periphery of the shaft 31. The permanent magnet 32 has an outer periphery facing the magnetic pole face 221 of each pole 22. The permanent magnet 32 has a length along the axis of the rotor 3 equal to that of each magnetic pole face 221 along the axis of the rotor 3, so that the permanent magnet 32 can induce the magnetic poles formed by the magnetic pole faces 221. Thus, the DC fan of the inner rotor type according to the preferred teachings of the present invention provides enhanced driving efficiency. Furthermore, an air gap is formed between the outer periphery of the permanent magnet 32 and each magnetic pole face 221.

The drive control unit 5 is fixed between the bottom plate 122 and the positioning member 123 along the axis of the rotor 3 about which the shaft 31 rotates. The drive control unit 5 is electrically connected to each coil 23 of the stator 2. Furthermore, the drive control unit 5 is electrically connected to an external DC power source.

In operation of the DC fan according to the preferred teachings of the present invention, the drive control unit 5 receives power generated by the DC power source and generates the control current outputted to the coils 23 of the stator 2. The control current causes magnetization of the magnetic pole faces 221 of the poles 22 into magnetic poles that create a repulsive action with the permanent magnet 32 of the rotor 3. Thus, the rotor 3 and the impeller 4 are driven to rotate relative to the housing 1. Since no brushes and no converters are required in the DC fan according to the preferred teachings of the present invention, the control current can be directly transmitted from the drive control unit 5 to the stator 2, significantly reducing interference and noise signals during transmission of the control current. Thus, the circuitry of the drive control unit 5 can be formed by intelligent integrated circuits. Furthermore, a high-precision control current can be outputted to each coil 23 for speed control for achieving high control sensitivity and high control precision without the risk of excessive interference or noise signals.

More specifically, by arranging a current switching circuit in the drive control unit 5, a feedback signal can be generated based on the operation of the current switching circuit to proceed with precise servocontrol of the speed of the DC fan according to the preferred teachings of the present invention. Furthermore, the pulse width modulation can be utilized in the drive control unit 5 to adjust the average power applied to the stator 2 by changing the pulse width at the period of time of conduction. Further, the control current of the drive control unit 5 can be detected and fed back directly so as to generate and send an alarm signal when abnormal operation occurs. These arrangements apply to cases where the DC fan according to the preferred teachings of the present invention is integrated into other devices.

According to the above, compared to conventional DC fans requiring brushes and converters to transmit DC power that lead to excessive noise signals in the DC power, the DC fan of the inner rotor type according to the preferred teachings of the present invention can directly transmit the control current from the drive control unit 5 to the stator 2 with high precision to avoid excessive noise signals in the control current, allowing intelligent control of the speed through the drive control unit 5. Furthermore, the stator 2 can be directly fixed in the compartment 10 of the housing 1 by injection molding, effectively enhancing the assembling convenience of the DC fan according to the preferred teachings of the present invention.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A DC fan comprising:

a housing including a frame defining a compartment;

a rotor rotatably received in the compartment, with the rotor including a shaft having an outer periphery and a permanent magnet fixed to and around the outer periphery of the shaft, with the permanent magnet having an outer periphery;

a stator fixed in the compartment of the frame and surrounding the rotor, with the stator including a plurality of magnetic pole faces facing the outer periphery of the permanent magnet, with an air gap formed between each of the plurality of magnetic pole faces and the permanent magnet, with the stator further including at least one coil;

an impeller coupled to a first axial end of the shaft and including a plurality of blades having a radial extent from the shaft, wherein the at least one coil is located within the radial extent of the plurality of blades;

a drive control unit mounted in the compartment and electrically connected to said at least one coil of the stator; and the shaft being rotatably mounted on the first and second bearings, with the frame including a body located within and spaced from the housing, a bottom plate, and a positioning member, with connecting members extending between the body and the housing and having passageways formed therein, with the at least one coil located inside the body, with the body and the bottom plate coupled to each other and defining the compartment, with the positioning member fixed in the compartment and adjacent the stator, with the first bearing mounted in the body and the second bearing mounted in the positioning member, with the permanent magnet located intermediate the first and second bearings, and with the drive control unit fixed between the bottom plate and the positioning member along an axis of the rotor about which the shaft rotates, with the shaft having a second axial end opposite to the first axial end, with the drive control unit located intermediate the second axial end of the shaft and the bottom plate, with the radial extent of the plurality of blades being inside of the housing, with the plurality of blades extending between the body and the housing and within an axial extent of the at least one coil.

2. The DC fan as claimed in claim 1, wherein the frame is formed by injection molding to enclose and engage with the stator.

3. The DC fan as claimed in claim 1, with the permanent magnet having a length along an axis of the rotor equal to that of each of the plurality of magnetic pole faces along the axis of the rotor.

4. The DC fan as claimed in claim 1, with the stator comprising more than one coil, with the stator including a plurality of poles each having an end facing the rotor and each forming one of the plurality of magnetic pole faces, and with one of the more than one coil respectively wound around the plurality of poles, with the plurality of blades extending within an axial extent of the plurality of poles.

5. The DC fan as claimed in claim 4, with the stator further including a cylindrical body received in the body and having an inner periphery, and with each of the plurality of poles having another end interconnected to the inner periphery of the cylindrical body.

* * * * *